US005465436A

United States Patent [19]

Bleicher

[11] Patent Number: 5,465,436

[45] Date of Patent: Nov. 14, 1995

[54] DISPOSABLE HYDROTHERAPY TANK LINER

[76] Inventor: Joel N. Bleicher, Rte. 3, Box 70, Council Bluffs, Iowa 51503

[21] Appl. No.: 366,220

[22] Filed: Dec. 29, 1994

Related U.S. Application Data

[63] Continuation of Ser. No. 95,782, Jul. 21, 1993, abandoned, which is a continuation-in-part of Ser. No. 53,786, Apr. 28, 1993, abandoned, which is a continuation-in-part of Ser. No. 821,329, Jan. 13, 1992, abandoned, which is a continuation-in-part of Ser. No. 697,129, May 6, 1991, abandoned, which is a continuation-in-part of Ser. No. 562,840, Aug. 6, 1990, abandoned.

[51] Int. Cl.[6] ..... A47K 3/02

[52] U.S. Cl. ..... 4/580; 4/DIG. 18; 383/206; 383/209

[58] Field of Search ..... 4/580–583, 655, 4/657, DIG. 18, 541.1–541.4; 383/206, 209

[56] References Cited

U.S. PATENT DOCUMENTS

| | | | |
|---|---|---|---|
| 550,542 | 11/1885 | Smith . | |
| 1,992,008 | 2/1935 | Innis . | |
| 2,684,807 | 7/1954 | Gerrish | 383/206 |
| 3,045,254 | 7/1962 | Cook et al. . | |
| 3,300,790 | 1/1967 | Foote . | |
| 3,504,844 | 4/1970 | Stark et al. . | |
| 3,857,118 | 12/1974 | Mamo et al. . | |
| 3,865,104 | 2/1975 | Paulson et al. . | |
| 4,285,078 | 8/1981 | Batstone . | |
| 4,561,134 | 12/1985 | Mathews et al. . | |
| 4,660,737 | 4/1987 | Green et al. . | |
| 4,713,849 | 12/1987 | Kindness . | |
| 4,893,362 | 1/1990 | Murphy . | |
| 4,953,729 | 9/1990 | Kloosterhouse | 383/206 X |
| 4,970,734 | 11/1990 | Friedman et al. . | |
| 5,040,252 | 8/1991 | Taggart | 4/580 |
| 5,216,764 | 6/1993 | Hall et al. | 4/583 |

FOREIGN PATENT DOCUMENTS

| | | |
|---|---|---|
| 2244411 | 9/1972 | Germany . |

*Primary Examiner*—Charles E. Phillips
*Attorney, Agent, or Firm*—Suiter & Associates

[57] ABSTRACT

The present invention teaches a disposable hydrotherapy tank liner formed of a fluid impervious sheet material. The liner is secured to the upper rim of a hydrotherapy tank by means of any suitable fastener such as a plurality of clips. The liner is adapted to occupy the interior of the tank and serves to isolate the interior surface of the tank from contact with hydrotherapy fluids. The liner utilizes a pull strip or rip cord assembly to open a liner drain hole so that the therapist may avoid contact with the hydrotherapy fluids. Further, an adhesive applied to the exterior of the liner and surrounding the liner drain hole removably secures the liner to the bottom of the tank adjacent the tank drain hole to aid in preventing fluids from contacting the floor of the tank during draining.

2 Claims, 6 Drawing Sheets

DISPOSABLE HYDROTHERAPY TANK LINER

CROSS REFERENCE TO RELATED APPLICATIONS

This application is a continuation of U.S. Ser. No. 08/095,782 filed Jul. 21, 1993 which is a continuation-in-part of U.S. Ser. No. 08/053,786 filed Apr. 28, 1993, which is a continuation-in-part of U.S. Ser. No. 07/821,329 filed on Jan. 13, 1992, which is a continuation-in-part of U.S. Ser. No. 07/697,129 filed on May 8, 1991, which in turn is a continuation-in-part of U.S. Ser. No. 07/582,840 filed on Aug. 6, 1990 all now abandoned. The before mentioned applications are incorporated herein by reference in their entirety.

TECHNICAL FIELD

This invention is directed to water impervious liners, and more particularly to disposable water impervious liners for use with hydrotherapy tanks and the like.

BACKGROUND ART

The spread of infectious diseases through whirlpool baths and hydrotherapy tanks is well documented. For example, see Ringham, S., "A Whirlpool of bacteria . . . therapy bath . . . vector of cross-infection," *Nursing Times* 1989, Vol. 85, pp. 77, 80; Spitalny, K. C., "National survey on outbreaks associated with whirlpool spas," *Am. J. Public Health* 1984, Vol 74, pp. 725–6; Crandall, R. A. "Pathogenic hazards and public spa and hot tub facilities," *Can. J. Public Health* 1984, Vol 75, pp. 223–6; Shaw, J. W., "A retrospective of the effectiveness of bromination and chlorination in controlling Pseudomonas Aeruginosa in spas (whirlpools) in Alberta," *Can. J. Public Health* 1984, Vol. 75, pp. 61–8; Mangione, E., et al., "An outbreak of Pontiac Fever related to whirlpool use, Michigan 1982," *J.A.M.A.* 1985, Vol. 253, pp. 535–39; Salmen, P., et al., "Whirlpool-associated Pseudomonas Aeruginosa urinary tract infections," *J.A.M.A.* 1983, Vol 250, pp. 2025–26; and Rose, H. D., et al., "Pseudomonas Pneumonia associated with use of a home whirlpool spa," *J.A.M.A.* 1983, Vol. 250, pp. 2027–29.

Occupational and physical therapists often provide patients with whirlpool baths. Whirlpool baths are also commonly utilized as a heat modality, to debride open wounds, to relax muscles, to facilitate range of motion treatments, to soften tissue, to increase blood flow, to relieve pain, to increase the extensibility of collagen tissue, to decrease joint stiffness, and to increase tendon excursion following surgical repair.

It is often impossible for a health care provider to determine whether an individual is a carrier of an infectious disease that might be transferred to subsequent users of a whirlpool bath.

Ideally all baths should be thoroughly disinfected between whirlpool treatments. However, baths are often not cleaned and disinfected between uses due to time and cost constraints. Additionally, even thorough cleaning of baths does not assure that all pathogens have been removed or rendered harmless.

The literature has also reported that homosexuals are frequent patrons of bath-houses. See, for example, McKusick, L., et al., "Reported changes in the sexual behavior of men at risk for AIDS," *Public health Rep.* 1985, Vol 100(6), pp. 622–29; and McKusick. L., et al., "AIDS and sexual behavior reported by gay men in San Francisco," *Am. J. Public Health* 1985, Vol. 75(5), pp. 493–36.

AIDS or "acquired immunodeficiency syndrome" is a deadly disease for which there is no known cure. Many individuals carry the virus that causes AIDS without exhibiting any AIDS symptoms, and it is impossible for a bath-house proprietor to assess the relative health of an individual prior to allowing that individual access to a bath.

Health care providers and bath-house proprietors are desirous of a means of reducing the risk of cross infecting their patients and patrons.

DISCLOSURE OF THE INVENTION

This invention describes a disposable hydrotherapy tank liner formed of a fluid impervious sheet material. The liner is secured to the upper rim of a hydrotherapy tank by means of any suitable fastener such as a plurality of clips, clamps, or magnets. The liner is adapted to occupy the interior of the tank and serves to isolate the interior surface of the tank from contact with hydrotherapy fluids. The liner utilizes a pull strip or rip cord assembly to open the liner drain hole so that the therapist may avoid contact with the hydrotherapy fluids. Further, an adhesive applied to the exterior of the liner and surrounding the liner drain hole removably secures the liner to the bottom of the tank adjacent the tank drain hole to aid in preventing fluids from contacting the floor of the tank during draining.

BEST MODE FOR CARRYING OUT THE INVENTION

Figure 1:
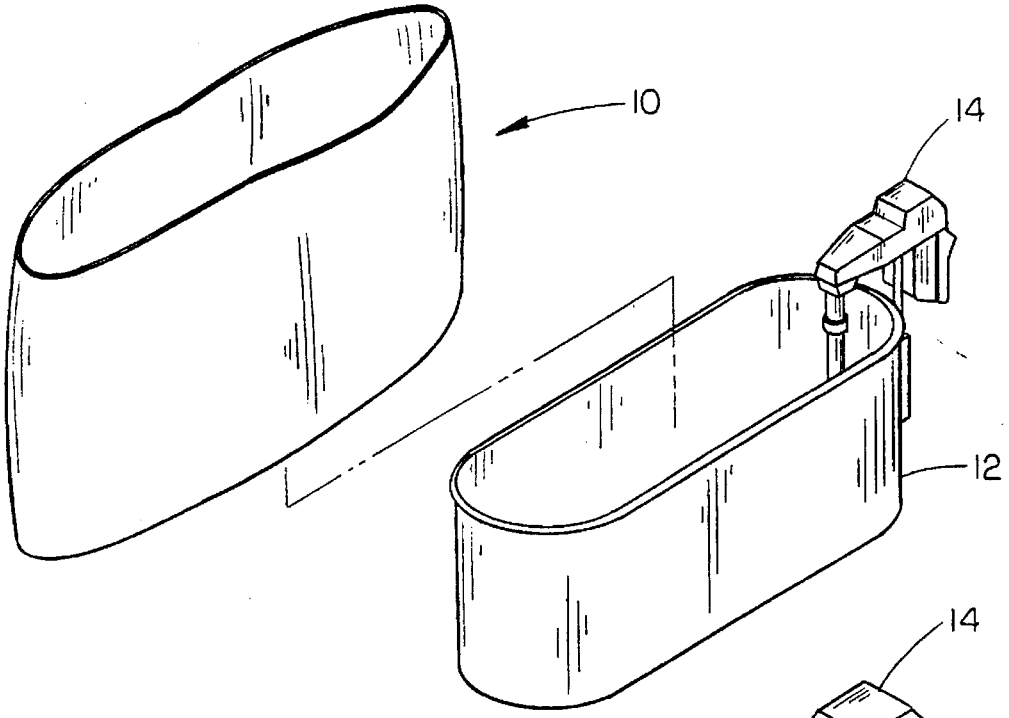
FIG. 1 is a perspective view of the invention and a hydrotherapy tank.
Figure 2:
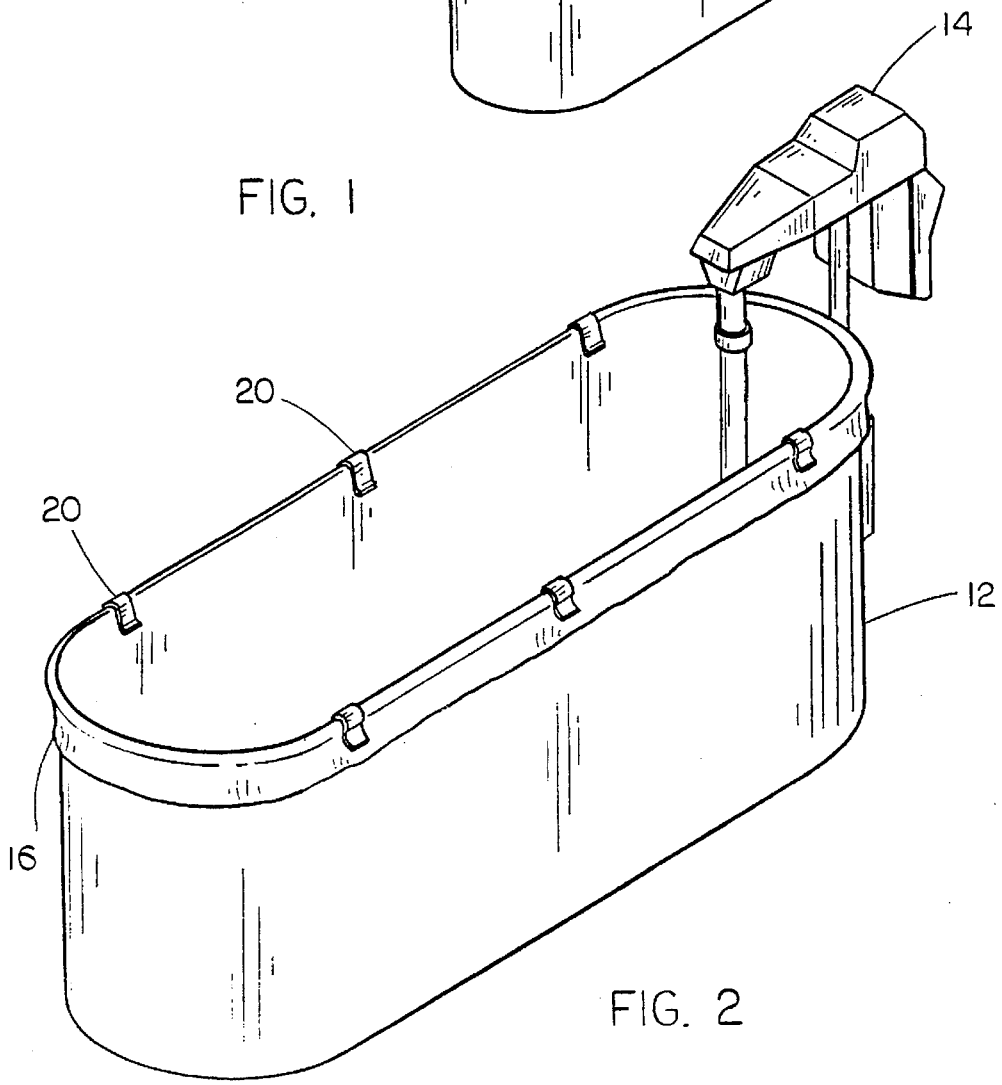
FIG. 2 is a perspective view of the invention installed within a hydrotherapy tank.

Referring now to the drawings, wherein like reference numerals designate identical or corresponding parts throughout the several views, the invention 10 is manufactured from a water impervious material and is designed to substantially conform to the interior of a standard hydrotherapy tank 12. Hydrotherapy tanks 12 typically have an oval configuration with vertical or near-vertical side walls and a horizontal floor. These tanks are fitted with a turbine unit 14 which agitates the water within the tank to provide hydrotherapy for a patient seated within the tank.

Figure 3:
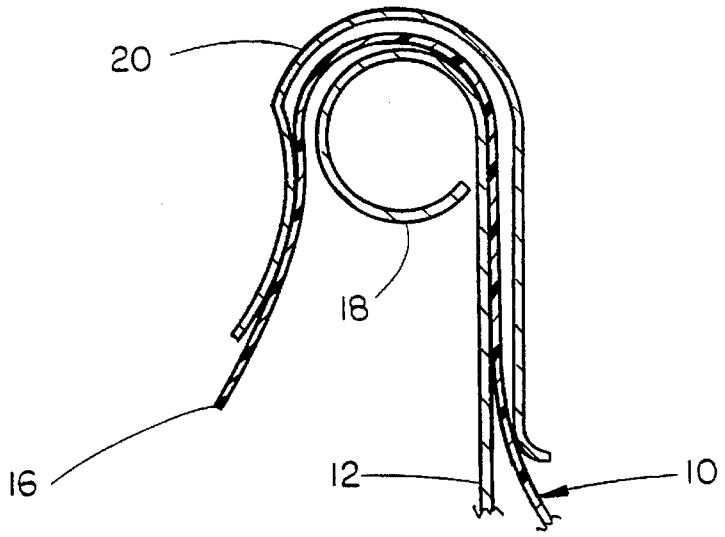
FIG. 3 is a cross-sectional view of the upper rim of a hydrotherapy tank with a liner installed and held in place with a rim clip.

When the liner 10 has been placed within the tank 12, the edges 16 are then turned over the upper rim of the tank and are secured by means of a plurality of resilient clips 20. This method of fastening is best seen in FIG. 3, where the edge 16 of the liner 10 is turned over the rim of the tank 18, and then resilient clip 20 is snapped over the tank rim 18 and secures the liner within. The clips 20 may be made of a resilient metal or plastic material and are intended to be disposed of after use so as to further decrease the risk of future contamination.

Figure 4A:
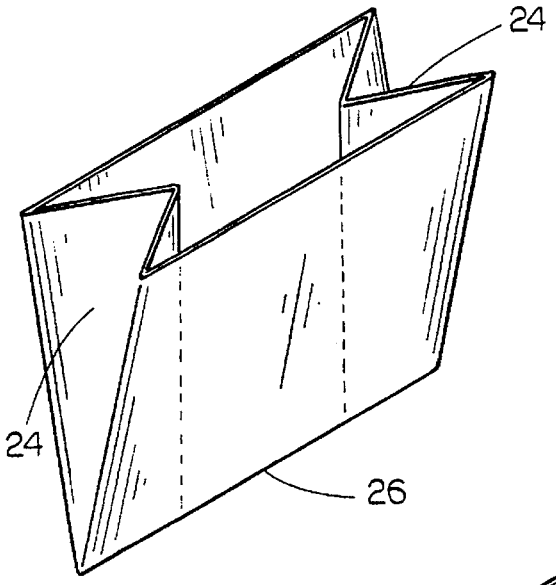
FIG. 4A is a perspective views of a preferred embodiment of the invention while folded.
Figure 4B:
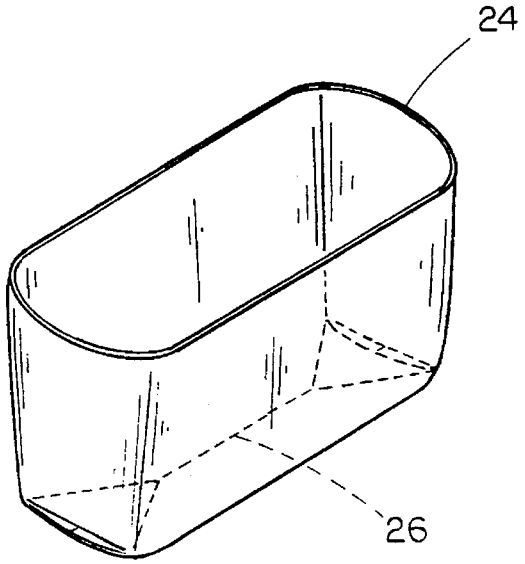
FIG. 4B is a perspective view of a preferred embodiment of the invention when unfolded.

The liner 10 may of course be manufactured in any number of ways, but in the preferred embodiment as seen in FIG. 4A and FIG. 4B the liner has a pair of pleated sides 24, formed just after the extrusion process. The bottom 26 of the liner is then sealed, preferably thermally. In FIG. 4B the pleats 24 have been opened to form a liner which substantially conforms to the interior of the hydrotherapy tank.

Figure 5:
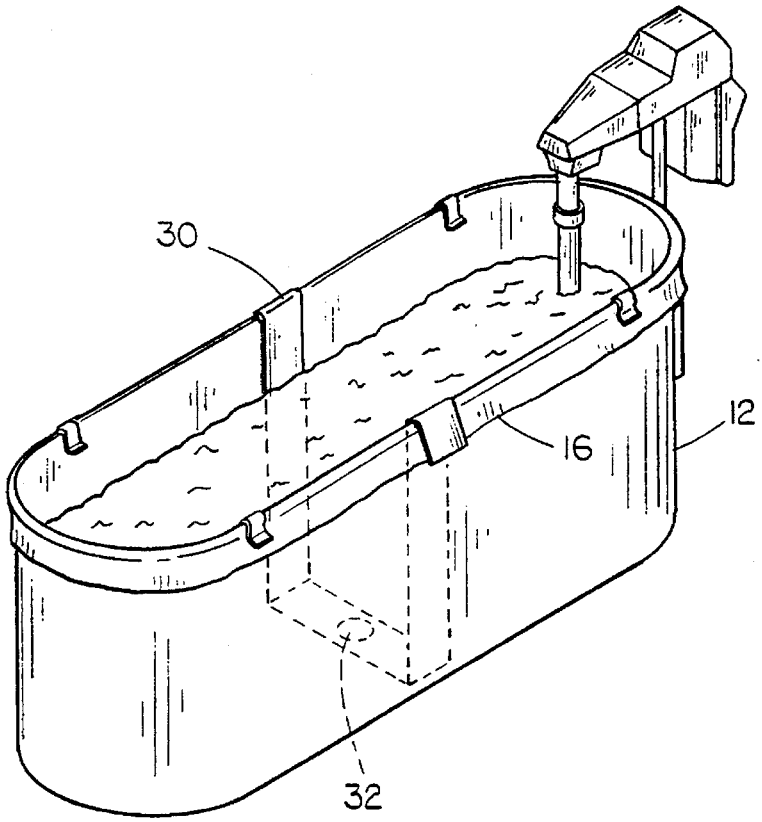
FIG. 5 is a perspective view of a first embodiment of the invention in actual use.
Figure 6:
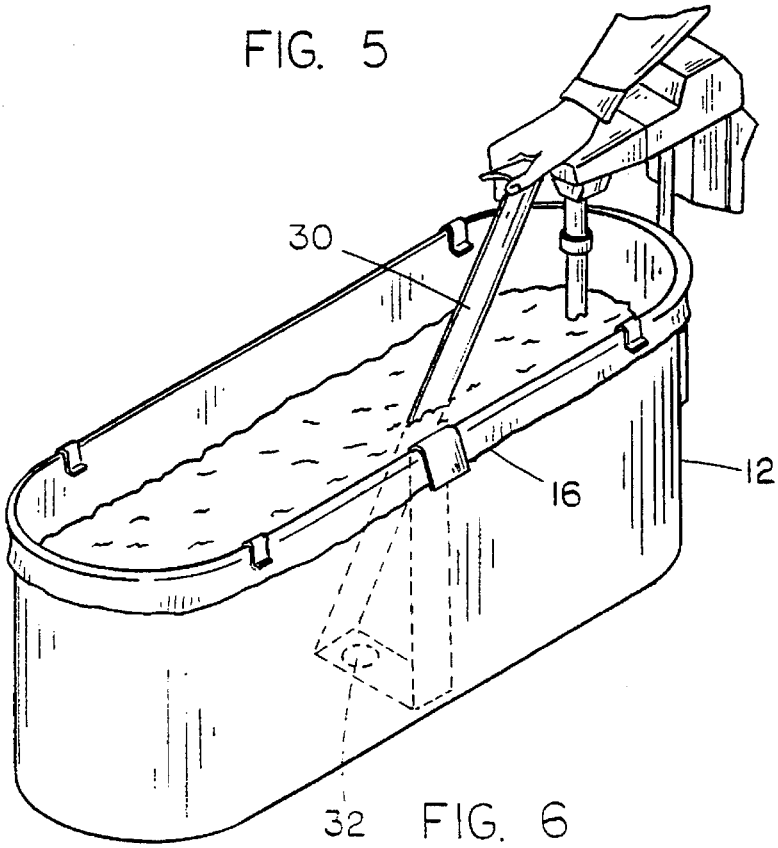
FIG. 6 is a perspective view of a first embodiment of the invention during draining.

FIG. 5 through FIG. 10 depict first three embodiments of means for draining the hydrotherapy tank and liner which permits the therapist to drain the unit without contacting the fluid therein, thus greatly reducing the risk of transmission of communicable disease to the therapist. In FIG. 5 and FIG. 6, a strip of water impervious material 30 having an adhesive on one side is affixed to the interior of the liner 10 such that it covers and seals a drain hole 32 formed through the liner. The ends of the strip 30 extend to at least one, preferably two, edges 16 of the liner where they may be grasped by the therapist and pulled so as to uncover liner drain hole 32 which has been positioned adjacent tank drain hole 50.

Figure 7A:
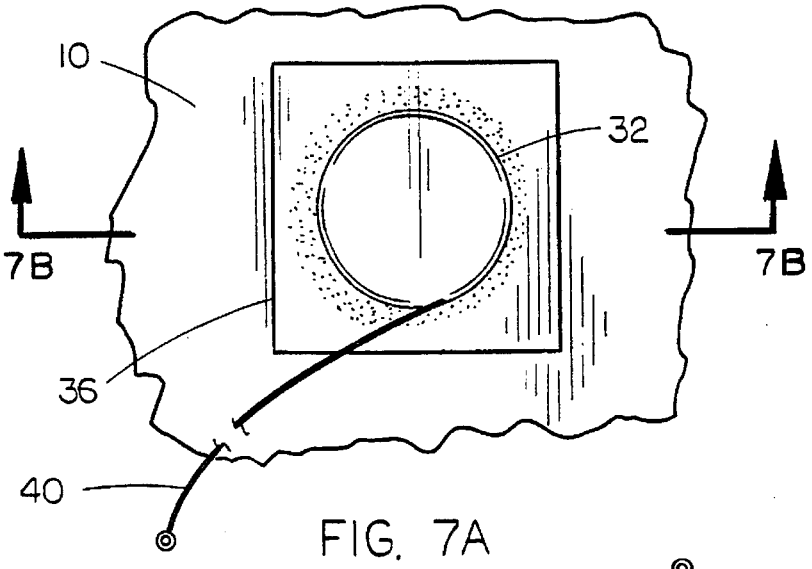
FIG. 7A is a top view of the drain of a second embodiment of the invention.
Figure 7B:
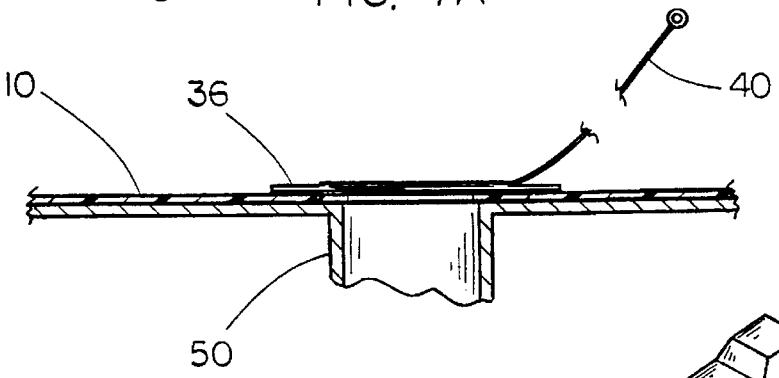
FIG. 7B is a sectional view taken along the line 7B—7B of FIG. 7A.
Figure 8:
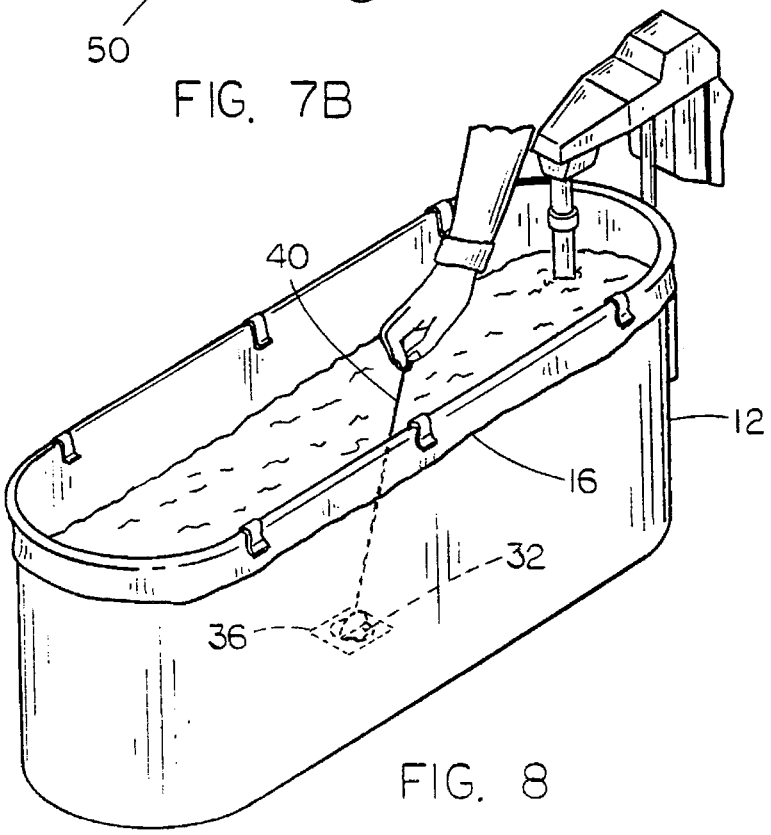
FIG. 8 is a perspective view of a second embodiment of the invention during draining.

FIG. 7 and 8 depict a second embodiment of the invention in which the liner drain hole 32 is covered and sealed by means of a water impervious drain seal 36. The drain seal 36 is permanently secured in place over the liner drain hole 32 by means of an adhesive. Imbedded within drain seal 36 is a loop of monofilament line or string, hereinafter referred to as a ripcord 40, which then extends along the interior of the liner to the edge 16 of the liner where it may be grasped by a therapist. When the end of the ripcord 40 is pulled, a drain hole is torn out of the drain seal 36 which then allows the water to drain through the tank drain hole 50. It is of course obvious to one skilled in the art that the ripcord could be imbedded into the liner material itself such that it would tear a drain hole in the liner when sufficient force is applied to the rip cord.

Figure 9A:
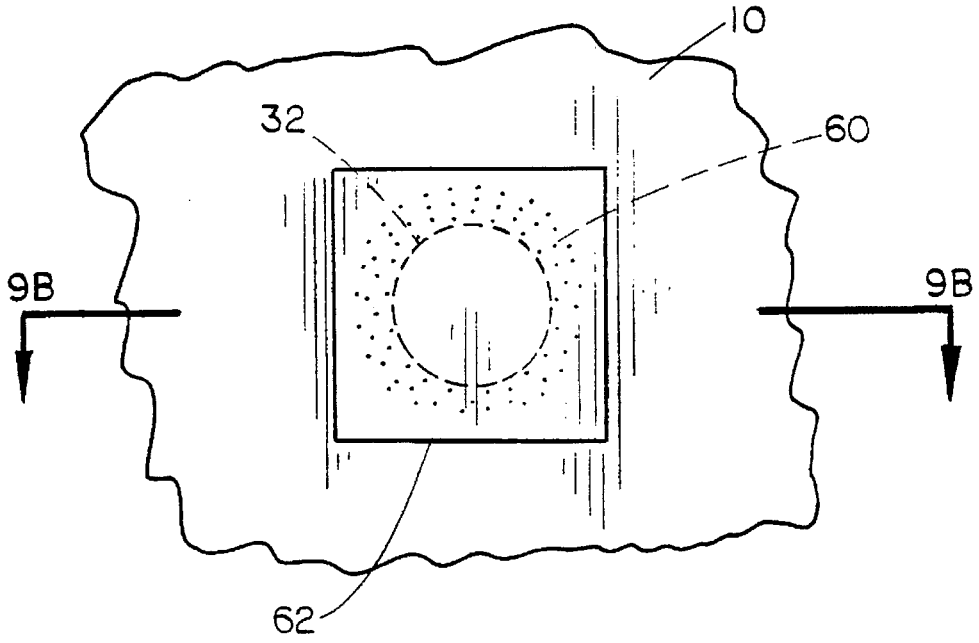
FIG. 9A is a bottom view of the drain of the invention.
Figure 9B:
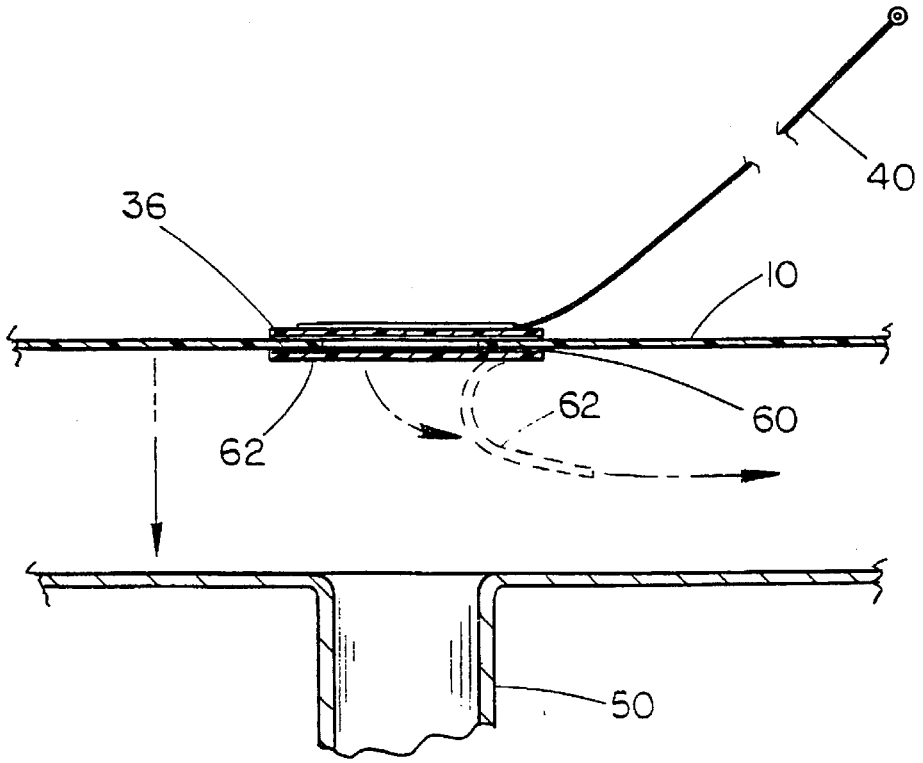
FIG. 9B is a sectional view taken along the line 9B–9B of FIG. 9A which also shows the tank drain.

As depicted in FIG. 9A and 9B, an adhesive 60 may be applied to the bottom, exterior of the tank liner 10 surrounding the liner drain hole 32 so that the liner drain hole will remain adjacent to the tank drain hole 50 while the tank is being used for hydrotherapy. This adhesive 60 also aids in preventing water seepage along the interior of the tank while the liner is being drained. Furthermore, this adhesive aids in stabilizing the liner when the drain strip 30 or ripcord 40 is being pulled to open the drain hole. To prevent adhesive 60 from adhering to articles prior to use of the liner, the adhesive 60 may be covered with a protective sheet 62 which is easily stripped off just before the liner is placed within a hydrotherapy tank.

Figure 10A:
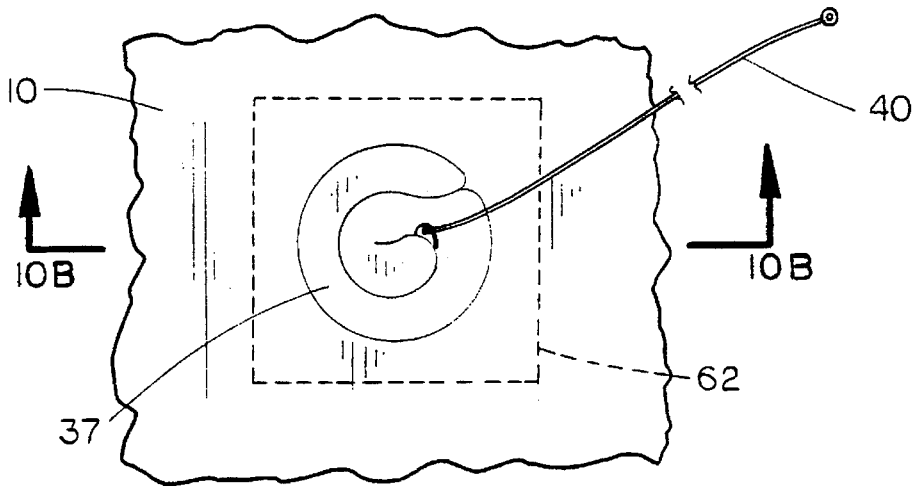
FIG. 10A is a top view of the drain of a third embodiment of the invention.
Figure 10B:
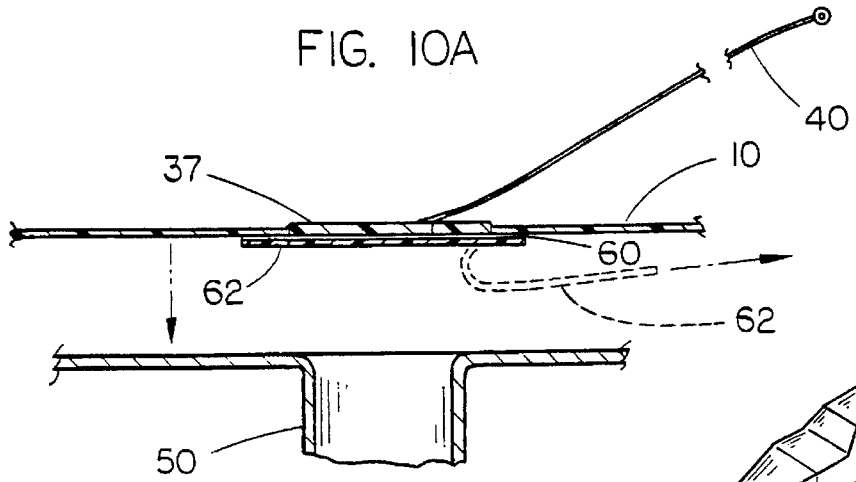
FIG. 10B is a sectional view taken along the line 10B–10B of FIG. 10A.
Figure 10C:
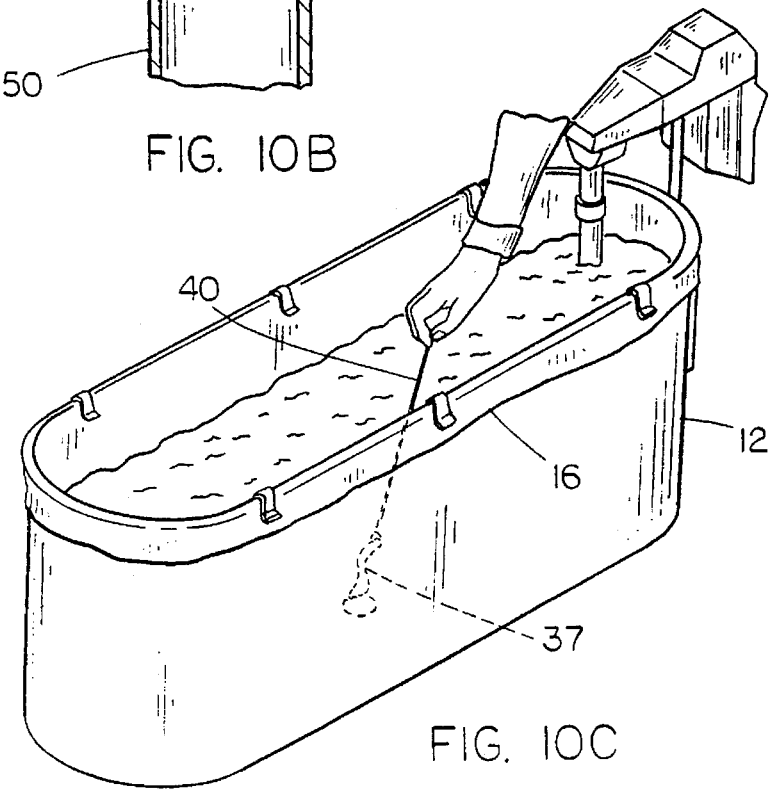
FIG. 10C is a perspective view of a third embodiment of the invention during draining.

A third embodiment of the invention is depicted in FIG. 10A, 10B, and 10C. In this embodiment, a liner tear-out section 37 has been formed into the liner material itself, having a generally spiral seam which will tear when sufficient force is applied. The ripcord 40 is secured to this tear-out section 37 and extends to the edge of the liner where it may be grasped and pulled by the therapist, thereby tearing a drain hole in the liner. As seen in FIG. 10B, this embodiment may also have an adhesive 60 applied to the bottom, exterior of the liner 10 surrounding the tear-out section 37. A protective sheet 62 may be used to cover the adhesive prior to use.

Those skilled in the art will recognize that many modifications and variations of the present invention are possible in light of the above teachings. It is therefore to be understood that, within the scope of the appended claims, the invention may be practiced otherwise than as specifically described.

I claim:

1. A disposable hydrotherapy tank liner for use in combination with a hydrotherapy tank having a drain hole, hydrotherapy fluids and a hydrotherapy tank turbine unit, said tank liner comprising: a sheet material impervious to liquids and having an interior surface and an exterior surface and a shape substantially conforming to the interior of a hydrotherapy tank; means for retaining said sheet material within said hydrotherapy tank;

a drain opening formed in said sheet material, means on said exterior surface surrounding said drain opening for securing said sheet material about the periphery of said drain hole, a drain opening seal attached to said interior surface and covering said drain opening so as to retain said hydrotherapy fluids on said interior surface, a ripcord embedded in said drain opening seal at one end and an opposite end extending above a normal fluid level of said tank, whereby a pulling force applied to said opposite end will cause said one end to tear a hole in said seal in order to allow said fluid to pass out of said drain hole.

2. A disposable hydrotherapy tank liner for use in combination with a hydrotherapy tank having a drain hole, hydrotherapy fluids and a hydrotherapy tank turbine unit, said tank liner, comprising:

a sheet material impervious of liquids and having an interior surface and an exterior surface and a shape substantially conforming to the interior of a hydrotherapy tank;

means for retaining said sheet material within said hydrotherapy tank;

means on said exterior surface for securing an area around said drain hole, a ripcord having one end formed into said sheet material in said area, and having an opposite end extending above the normal fluid level of said tank, whereby a pulling force applied to said opposite end will cause said one end to tear a hole in said area in order to allow said fluid to pass out of said drain hole.

* * * * *